United States Patent [19]

Bottom et al.

[11] Patent Number: 4,466,136

[45] Date of Patent: Aug. 21, 1984

[54] COMPOSITE T-SHIRT CONSTRUCTION

[76] Inventors: James T. Bottom, 452 Papworth Ave., Metairie, La. 70005; James J. Arnold, 511 Lowerline St.; Francis P. Thompson, 8715 Oak St., both of New Orleans, La. 70118

[21] Appl. No.: 428,891

[22] Filed: Sep. 30, 1982

[51] Int. Cl.[3] ..... A41B 1/00

[52] U.S. Cl. ..... 2/115; 2/1; 40/586; 84/267

[58] Field of Search ..... 2/115, 249, 247, 250, 2/206; 224/1 R; 40/129 A; 46/116

[56] References Cited

U.S. PATENT DOCUMENTS 2,628,452 2/1953 Gladstein ..... 2/249
2,871,485 2/1959 Greco ..... 2/246
3,484,974 12/1969 Culmone ..... 40/129
4,140,253 2/1979 Vickers et al. ..... 224/1 R
4,236,658 12/1980 Kallman ..... 224/250

FOREIGN PATENT DOCUMENTS 1497611 9/1967 France ..... 2/DIG. 6

*Primary Examiner*—Doris L. Troutman
*Attorney, Agent, or Firm*—Charles C. Garvey, Jr.

[57] ABSTRACT

A T-shirt on which a graphical representation comprises a portion imprinted on the T-shirt is a design of an overall object to be displayed with a 3-dimension self-supporting structure temporarily connected to the T-shirt completing the design.

3 Claims, 6 Drawing Figures

COMPOSITE T-SHIRT CONSTRUCTION

BACKGROUND OF THE INVENTION

1. Technical Field

The present invention relates to clothing and particularly to shirts and T-shirts. More particularly, the present invention relates to a T-shirt construction of a composite nature in which a graphical representation comprises a portion imprinted on the T-shirt and a structural portion affixed temporarily thereto while wearing.

2. General Background

Various expressions of art and graphics have been used to decorate clothing and shirts and particularly T-shirts. Various examples of devices have been patented which show the attachment of items to articles of clothing for various purposes.

See, for example, U.S. Pat. No. 3,484,974 entitled "Removable Identifying Characters for Clothing." That patent shows a jersey having an elongated strip which has an outer surface of a first separable fastening member, the strip being permanently secured to the clothing. A plurality of letters forming an individual's name are separably secured to the strip with the letters each having a rear surface formed of a second separable fastening member. One of the separable fastening members comprises a plurality of loop elements and the other separable fastening members comprises a plurality of resiliently deformable hook-shaped members adapted to engage the loop elements whereby the letters forming the name are secured to the strip by the separable engagement of the hooks with the loop elements.

A VELCRO fastener is used in U.S. Pat. No. 4,236,658 entitled "System for Holding Articles to Objects." In that patent a fastener device is shown which is used for attaching items such as binoculars and cameras to the clothing of the wearer.

Velcro fasteners are also used in U.S. Pat. No. 4,140,253 entitled "Gun Carrier" in order to attach a rifle or shotgun onto a strip of flexible material which is provided with belt loops so that the flexible material strip can be carried by the belt of the wearer. A mating element is affixed to the gun stock so that when the gun is held upright its stock is connected to the carrying unit through fasteners thus transferring the weight of the gun to the belt of the wearer.

A French Pat. No. 1,497,611 issued Oct. 13, 1967, provides a sign which can be affixed to a T-shirt in a removable fashion.

3. General Discussion of the Present Invention

The present invention provides a composite shirt construction in which a portion of an overall design is formed on the shirt itself and a second portion of the overall object design is in the form of a three-dimensional, removable member which affixes temporarily to the shirt. The combination provides thus a composite construction of the design, a portion of which is on the T-shirt and a portion of which is not.

The present invention thus provides a composite clothing article having a graphical representation which utilizes in part a three-dimensional structure, comprising a clothing article having on the surface thereof a graphical representation of a portion of an overall object to be displayed such as, for example, a guitar (see FIG. 1). A three-dimensional, self-supporting member (such as the guitar neck) is temporarily connectable to the shirt, with the connection completing an overall object display, the member being a portion thereof. In FIG. 1 the overall object to be displayed is a guitar. Means is provided for forming a temporary connection between the article of the clothing and the self-supporting member. In the preferred embodiment a Velcro-type fastener is used. The article of clothing is preferably a shirt. The object to be displayed can be any overall object such as a guitar, for example, with a portion of the object being formed permanently on the shirt itself such as by silk-screening and the other portion thereof being a three-dimensional portion manufactured of any self-supporting material such as foam, plastic, or the like.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
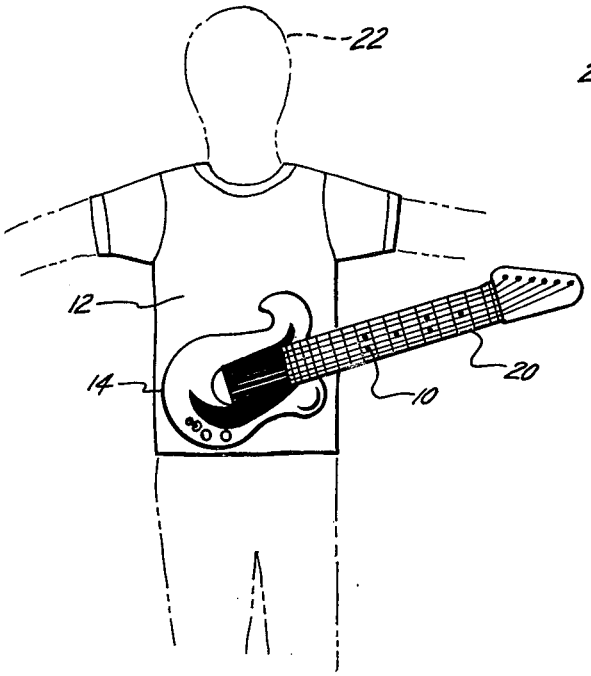
FIG. 1 is a front view of the preferred embodiment of the apparatus of the present invention, with a user being schematically shown in phantom lines.
Figure 3:
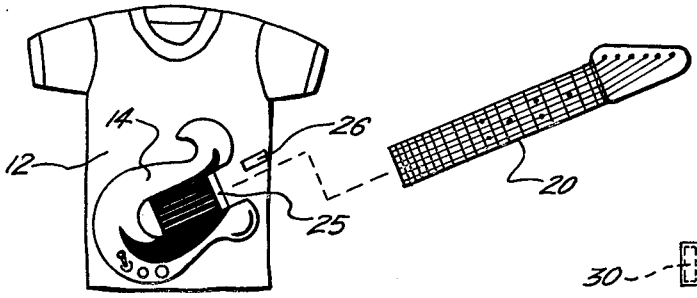
FIG. 3 is a exploded view of the preferred embodiment of the apparatus of the present invention showing portions thereof as being disconnected.

In FIG. 1 can be seen composite clothing article 10 and more particularly shirt 12 which can be, for example, a T-shirt having silk-screened or otherwise imprinted thereon design 14. In FIG. 1 as exemplary, the design is a portion of a guitar. In FIG. 3, the designed portion 14 can be more clearly seen as member 20 which has been removed as will be described more fully hereinafter.

Figure 2:
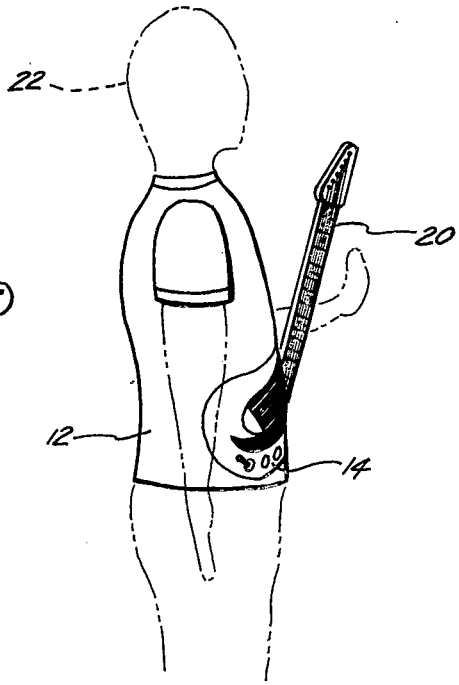
FIG. 2 is a side view of the preferred embodiment of the apparatus of the present invention with the user being schematically shown in phantom lines.

In FIGS. 1 and 2 a wearer 22 is shown in phantom lines.

A three-dimensional, self-supporting member 20 is removably affixed to shirt 12 by means of temporary connection means. In the preferred embodiment Velcro fasteners can be used and they are best seen in FIG. 3 as 25, 26, which would be fasteners sewed to shirt 12.

Figure 4:
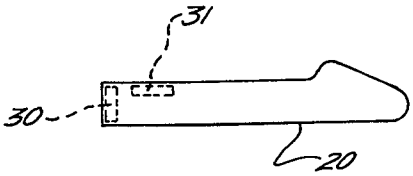
FIG. 4 is a top view of the removable portion of the preferred embodiment of the apparatus of the present invention.
Figure 5:
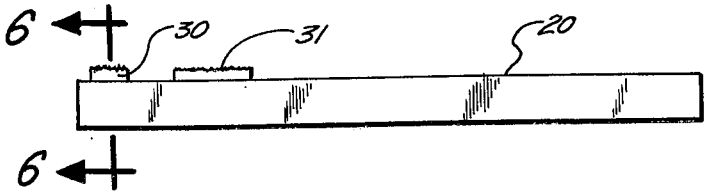
FIG. 5 is a side view thereof.
Figure 6:
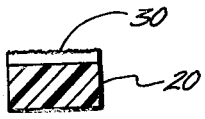
FIG. 6 is a sectional view taken along lines 6—6 of FIG. 5.

In FIG. 4, mating portions 30, 31 are shown which would be, for example, affixed by means such as gluing directly to member 20. In the embodiment of FIGS. 1–6, member 20 takes the form of the guitar neck.

Once member 20 is removed, shirt 12 can easily be washed without harm to the design which is permanently affixed thereto. Yet during use, member 20 is fastened in such a way as to complete an overall graphical representation of an object which in the case of FIGS. 1 and 2 is a guitar. The guitar neck is three-dimensional and extends laterally beyond the confines of the shirt perimeter as is shown in FIG. 1. The overall combination provides a toy or article of clothing which is quite unlike the mere representation of the article on the item of clothing itself. If the guitar, for example, of FIG. 1 were reproduced on the shirt 12 alone its side would be disproportionately small and it would not appear realistic in the eyes of a viewer. However when viewing FIG. 1, the composite design allows the guitar to be of a size and scale that it appears to be full sized and it appears that the wearer is, in fact, holding a guitar around his neck and in proximity to the torso of his body.

Variations would, of course, be possible within the teaching of the present invention.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A composite clothing article comprising:

a. a clothing article having on the surface thereof a graphical representation of a portion of an overall object to be displayed;

b. a three-dimensional, self-supporting member forming the remaining portion of the overall object to be displayed; and c. means for removably interconnecting the surface having the graphical representation and the self-supporting member such that the interconnected surface and the self-supporting member form the overall object to be displayed.

2. The composite clothing article of claim 1, wherein the article of clothing is a shirt.

3. The composite clothing article of claim 1, wherein the object to be displayed is a guitar and the self-supporting member is a guitar neck.

* * * * *